US005244213A

United States Patent [19]

Armell

[11] Patent Number: 5,244,213

[45] Date of Patent: Sep. 14, 1993

[54] PORTABLE SPORTS GOAL

[76] Inventor: Robert S. Armell, 199 Clark Rd., Brookline, Mass. 02146

[21] Appl. No.: 926,992

[22] Filed: Aug. 10, 1992

[51] Int. Cl.[5] ..... A63B 63/00

[52] U.S. Cl. ..... 273/400

[58] Field of Search ..... 273/396, 398, 400, 401, 273/411

[56] References Cited

U.S. PATENT DOCUMENTS

| | | | |
|---|---|---|---|
| 3,945,641 | 3/1976 | Carbonero | 273/411 |
| 4,127,272 | 11/1978 | Pennell | 273/398 |
| 4,286,786 | 9/1981 | Papadopoulos | 273/396 |
| 4,407,507 | 10/1983 | Caruso et al. | 273/400 |
| 4,822,053 | 4/1989 | Flaherty | 273/411 |
| 5,000,461 | 3/1991 | Borazjani | 273/401 |
| 5,018,746 | 5/1991 | Cardoza, Jr. et al. | 273/411 |
| 5,048,844 | 9/1991 | Haseltine | 273/400 |
| 5,080,375 | 1/1992 | Moosavi | 273/400 |

*Primary Examiner*—William H. Grieb
*Attorney, Agent, or Firm*—William Nitkin

[57] ABSTRACT

A sports goal having a first arcuate pole interconnected at its ends to the ends of a second arcuate pole disposed at 90 degrees to the first pole, the second pole resting on the ground and the first pole forming the mouth of the goal. A net member extends between the two poles, and a strap member joins the points of attachment holding the ends of the poles, such strap member forming a goal line.

12 Claims, 4 Drawing Sheets

PORTABLE SPORTS GOAL

BACKGROUND OF THE INVENTION

1. Field of the Invention

The structure of this invention resides in the area of sports goals and more particularly relates to a portable sports goal that is lightweight and which when struck by an individual or an object with sufficient force will yield and when such force thereagainst is removed, will re-erect itself.

2. Description of the Prior Art

Many ball games utilizing sports goals are often played informally in fields and areas which do not have standard goal structures. Because such games are often impromptu gatherings, it is difficult and usually impossible for the players to bring conventional, full-size goals which for the most part are installed in permanent locations on fields. In such situations players will often use non-standard structures as goals such as stakes, T-shirts or any visible object which can be used to define a goal area for the purpose of the game. For example, if soccer is played or other similar sport where the ball must pass into a goal in order to score points, the ball can be directed between two markers in order to provide a scoring situation. Many times though when using informal goals disagreements can arise among players as to whether points have been scored based on whether the ball has passed outside or above the goal area.

To address the above concerns, portable sports goals have been developed in the prior art such as, for example, the Adjustable Soccer Goal of Moosavi, U.S. Pat. No. 5,080,375; the Portable Soccer Goal Apparatus of Borazjani, U.S. Pat. No. 5,000,461; and Portable Soccer Goal of Caruso et al, U.S. Pat. No. 4,407,507; and Portable Soccer Goal of Pennell, U.S. Pat. No. 4,127,272. The inventions of Pennell and Caruso et al employ a system of triangular braces or straight line framing pieces. Some of these goals utilize separate parts which are assembled into a goal framework. Some portable sports goals have features which cause the ball to rebound out of the goal such as found in U.S. Pat. No. 5,048,844 of Haseltine or some that return the ball in a particular way such as in U.S. Pat. No. 4,286,786 of Papadopolis.

SUMMARY OF THE INVENTION

It is an object of this invention to provide an inexpensive, lightweight and self-contained portable sports goal which can be used in an informal game of soccer or other goal-requiring ball game. The framework can be assembled and disassembled quickly and easily as the parts of the structure are always right at hand since all parts of the sports goal of this invention can be attached to one another so as to prevent separation of individual parts and possible loss thereof when the sports goal is in its storage mode.

It is a further object of this invention that the sports goal, when in its use mode, be extremely portable so that it can be carried by hand; and when knocked down and packed up in its storage mode, be easily carried by hand, on the shoulder or even in a backpack.

It is a still further object of this invention that the upper portion of the structure be yielding when struck by a player. This safety feature allows the structure to yield when sufficient external pressure is applied against it and to spring back when such pressure is removed.

To accomplish these objects in the present invention, the sports goal is provided with a base pole and an upright pole connected to two attachment members which poles are maintained in an arcuately bowed state by a strap extending between the two attachment members. The base pole and the upright pole can be of the same length. The base pole rests horizontally on the ground with a net member interconnecting the base pole and upright pole to define the top, back and sides of the sports goal. The invention herein can utilize multi-segmented tubular poles, all the segments, when separated, being connected together by an elastic cord running through the hollow core of each pole to retain each pole segment together for easy dismantling and all aligned for easy reassembling thereof. The ends of the vertically disposed, upright pole can be attached in one embodiment to hinge springs within the attachment members so that when sufficient pressure is placed thereagainst, the upright pole moves downward within a slot toward the horizontal base pole, and the upright pole will return to its vertically upright position when pressure thereagainst, such as from a player falling on the structure, is removed.

DESCRIPTION OF THE PREFERRED EMBODIMENT(S)

Figure 1:
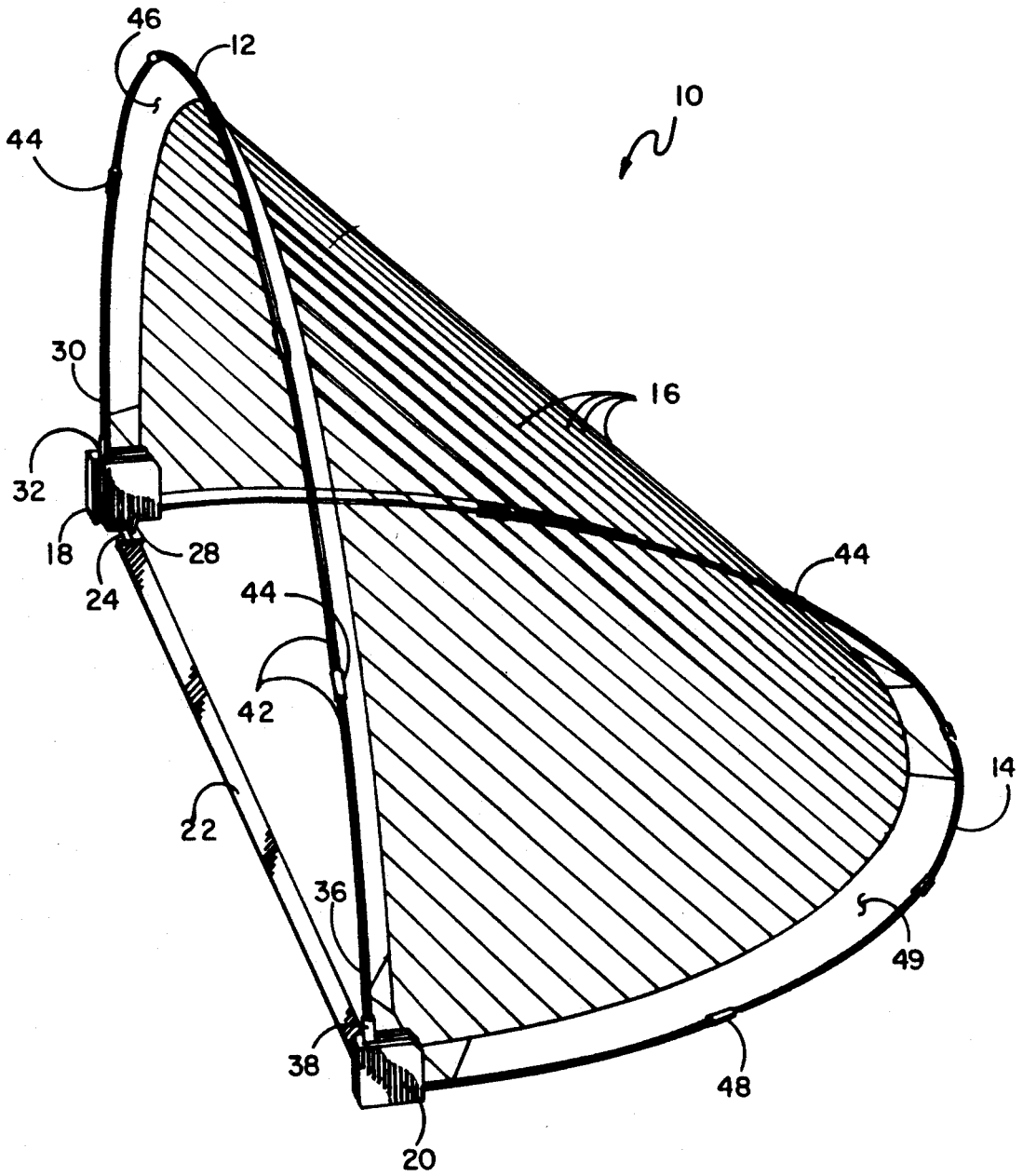
FIG. 1 illustrates a perspective view of the sports goal of this invention in its use mode.

The sports goal 10 of this invention as seen in FIG. 1 has an upright first pole 12 which in its use mode is bowed in an upside down U configuration forming the mouth of the sports goal. A second pole 14 is disposed horizontally on the ground and is also bowed with its ends engaged into first and second attachment members 18 and 20, respectively, into which attachment members the ends of the first pole 12 are also engaged. The poles can be made of aluminum, flexible plastic or equivalent material and have hollow cores. First pole 12 and second pole 14 are disposed at approximately 90 degrees to one another and joined to the attachment members. First and second poles 12 and 14 have net 16 extending therebetween. Strap member 22 or equivalent connecting means holds first attachment member 18 to second attachment member 20, pulling the attachment members together. The attachment members in one embodiment can hold first pole 12 rigidly in an upright position. In further embodiments described below, first pole 12 can move rearwardly, either bending at a portion(s) along its length or moving by means of hinge members disposed within the attachment members as described below. Other equivalent means to allow first pole 12 to move downward from an upright position can also be utilized.

Figure 3:
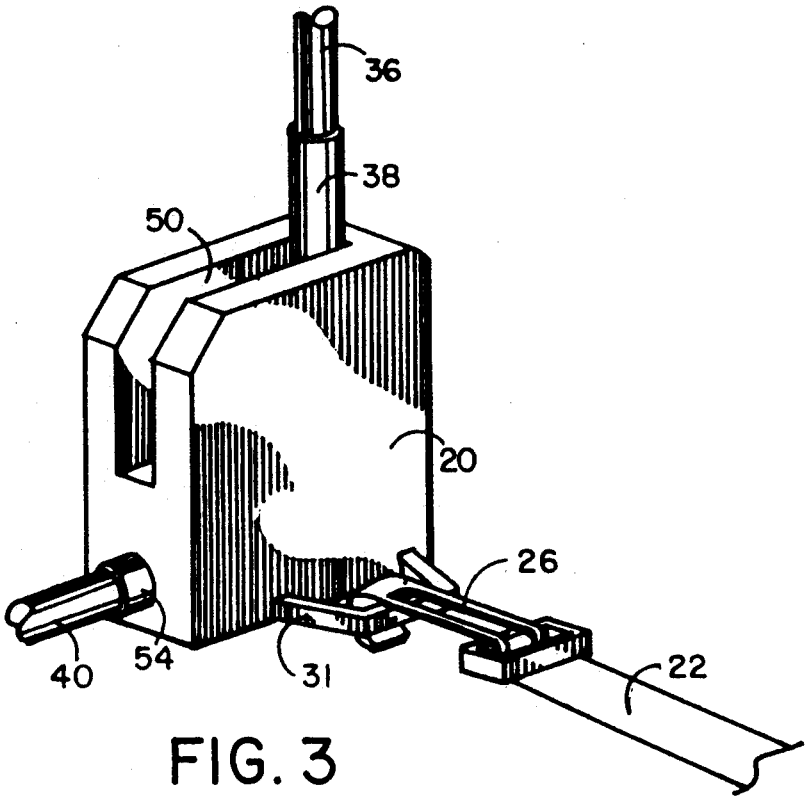
FIG. 3 illustrates a view of one of the attachment members with strap member attached thereto.

First and second ends 30 and 36 of first pole 12 are inserted, respectively, into first and second pole receipt members 32 and 38 which can be in one embodiment parts of first and second attachment members 18 and 20. In another embodiment first and second pole receipt members 32 and 38 can be disposed on first and second pole ends 30 and 36, respectively, and passed into apertures formed in first and second pole receipt members 32 and 38. First and second pole receipt members 32 and 38 in one embodiment can be disposed within slots 50, one of which is seen in FIG. 3, defined in first attachment member 18 and second attachment member 20, respectively. The first and second poles in a preferred embodiment can be of the same length and strap member 22 in such preferred embodiment is two-thirds the length of either pole which shorter length causes the poles, when inserted into the attachment members, to become bowed when the attachment members are pulled together, causing the poles to form two arcuate shapes perpendicular to each other. The pole members can also be of unequal lengths. Net member 16 can be of open, mesh-like net material, solid flexible sheet material or any other equivalent material to create a ball-receiving member. The net has sleeves along its sides in which the poles are positioned. The sleeves can be made of cloth or plastic material. The net defines the top, back and sides of the sports goal with the vertical disposed, upright first pole defining the mouth of the sports goal and strap 22 defining the goal line. In the use mode of this invention first hook 24 and the second hook, not shown in FIG. 1, are positioned at the ends of strap member 22 and attached respectively to first catch member 28 on first attachment member 18 and to second catch member 31, not seen in FIG. 1, on the inside of second attachment member 20.

Figure 2:
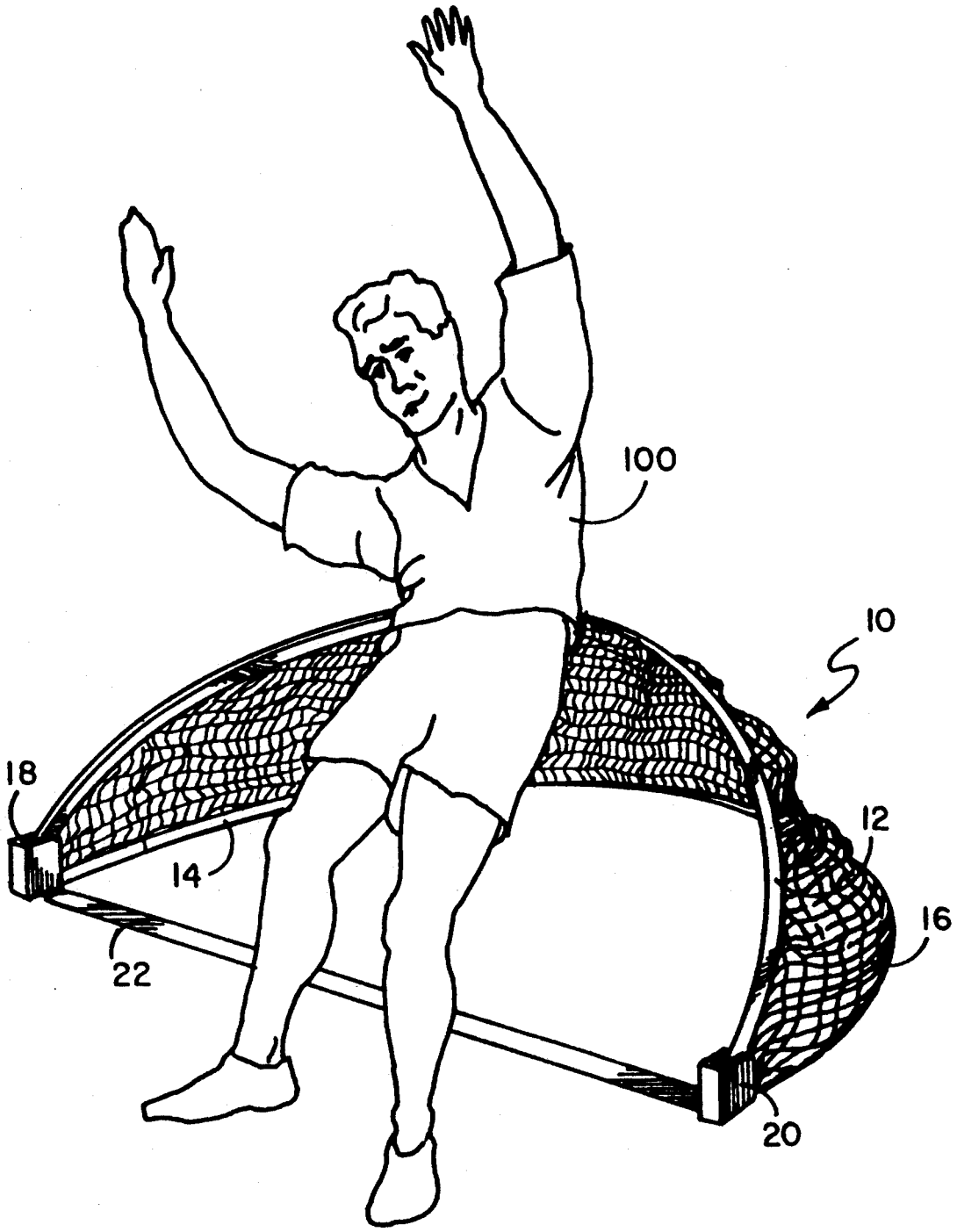
FIG. 2 illustrates a player falling against the sports goal of this invention, moving the upright member downward.
Figure 4:
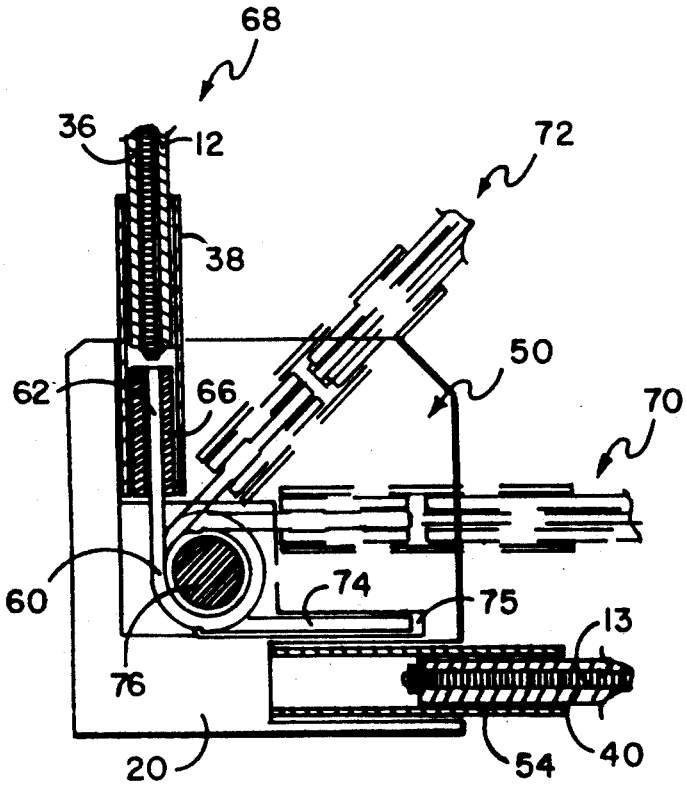
FIG. 4 illustrates a cross-sectional view through one of the attachment members showing the hinging mechanism.

When the sports goal is struck with sufficient pressure by a ball or a player, first pole 12 bends in a downwards and backwards direction, bending, depending on the embodiment of this invention, or rotating downwards on a hinge member toward second pole 14. In FIG. 2 one can see player 100 falling against sports goal 10 of this invention during the course of play with first pole 12 and net 16 attached thereto moving downward toward second pole 14. When the player gets up away from the sports goal, first pole 12 will return to its original upright, vertical position by action of the natural unbending tendency of the first pole if made of flexible material or if the pole is made of a stiffer material such as aluminum, by the action of hinge members, as will be described below and as illustrated in FIG. 4. The return of first pole 12 back to its original upright position restretches net 16 between the first and second poles to its ball-receiving configuration. Net 16 includes first pole sleeve 46 and second pole sleeve 49, seen in FIG. 1 as being transparent and formed along its sides, in which sleeves first and second poles 12 and 14 are positioned. The force of an impact may also cause the entire structure to be moved along the ground due to the lightness in weight of the structure. The structure, if so moved, can be easily repositioned.

In one embodiment illustrated in FIG. 1 of the sports goal of this invention first and second poles 12 and 14 are made up to a plurality of pole segments 42 which segments are held together by a plurality of pole segment connection members 44 which are engaged together in the sports goal's use mode to form first and second poles 12 and 14. A stretchable cord 13, seen in FIG. 6, passes through the hollow core of the poles/-pole segments so that they do not become totally separated from one another when disengaged but are interconnected by cord 13 for easy alignment and construction thereof when the sports goal is to be reassembled after storage. Cord 13 can be attached into the hollow core or to the first and second ends of each pole, respectively.

FIG. 3 illustrates a perspective view of the inner side of second attachment member 20. It should be noted that second attachment member 20 is of similar construction to first attachment member 18 but has its catch member 31 positioned on the opposite inner side of the sports goal for receipt of hook member 26 of strap member 22. In some embodiments strap member 22 can be adjustable in length or be replaced by a member attached to second pole 14 covering the entire bottom of the sports goal. In FIG. 3 can be seen second pole receipt member 38 positioned within second attachment member 20 which moves within slot 50, allowing second end 36 of first pole 12 to be moved downward when put under pressure toward a horizontal position or any intermediate position therebetween by any pressure thereagainst. Second pole receipt member 38 of first pole 12 is attached to a spring member, not seen in this view, within second attachment member 20. Second end 40 of second pole 14 is engaged into second pole receipt member 54 at the base of second attachment member 20.

FIG. 4 illustrates a cross-sectional view through second attachment member 20 showing details of the hinging mechanism which allows downward movement of first pole 12 when pressure is applied thereagainst and upwards movement when such pressure is removed. In this view one can see coil torsion spring 60 which passes around a fixed shaft 76. Coil torsion spring 60 has an upper arm 62 and a lower arm 74. Lower spring arm 74 is retained securely within lower arm slot 75. Upper spring arm 62 extends upwards into second pole receipt member 38 of the second end 36 of first pole 12. Upper arm 62 can have plug member 66 positioned around it to allow it to fit snugly within the bottom portion of second pole receipt member 38. Second end 36 of first pole 12 can pass into the upper portion of second pole receipt member 38 where it can be inserted or removed as desired when one wants to assemble or dismantle the sports goal of this invention. In some embodiments pole receipt member 38 can be an integral part of first pole 12 and be positioned onto plug member 66. Also seen in this view is cord 13 which can be made of stretchable material.

In use with no external force applied thereto, first pole 12 stands upright with the first and second poles being positioned at approximately 90 degrees to one another. When first pole 12 is struck by a player or an object, the pressure of such contact causes the sports goal to move inward in one embodiment, hinging downward on coil torsion spring 60. Upper arm 62 of spring 60 can bend all the way from its first upright position 68 to a second position 70 where it is parallel with second pole 14, virtually flattening the sports goal. Also shown in dotted lines is one intermediate position 72. First pole 12 can be pushed downward to many intermediate positions. Once the pressure that pushed first pole 12 downward, be it a player or a ball, is removed, coil torsion spring 60 by its spring action will cause first pole 12 to move quickly back to its first position 68. Because the sports goal of this invention has so much flexibility when pressure is applied to it, the structure is not easily broken when in use.

Figure 6:
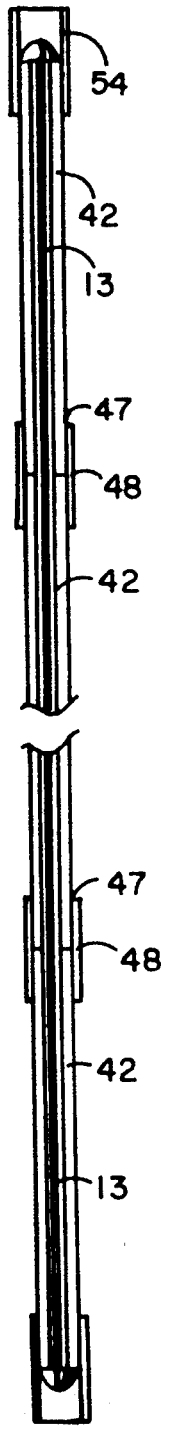
FIG. 6 illustrates one embodiment of a portion of a pole member showing a cord passing therethrough with pole segments interconnected by connection members.
Figure 5:
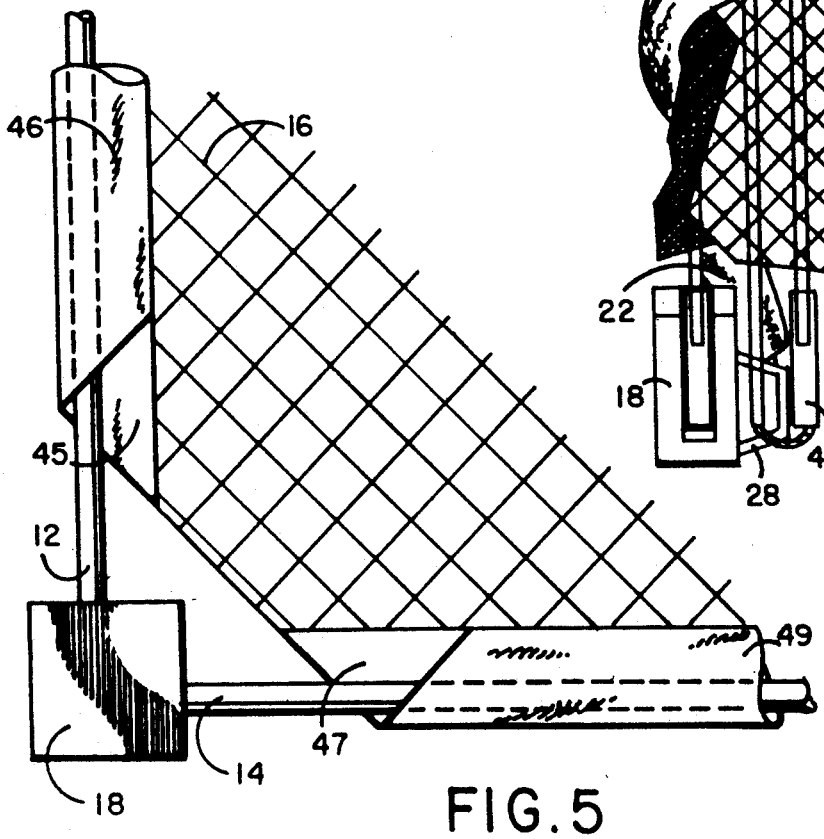
FIG. 5 illustrates a sectional view of one corner of the sports goal in its use mode showing the poles disposed within sleeves which sleeves are disposed along the sides of the net.

First and second pole members 12 and 14 are passed through sleeves formed along the sides of net 16, and in FIG. 5 one can see an inside sectional view of first attachment member 18 where first pole 12 and second pole 14 are engaged thereto and are shown respectively passing into first pole sleeve 46 through first pole sleeve opening 45 and into second pole sleeve 49 through second pole sleeve opening 47. Once passed therethrough, the poles do not have to be removed therefrom during storage. As mentioned above, first and second poles 12 and 14 in one embodiment can be dismantled into a plurality of pole segments which are disengageable from one another and held together by stretchable cord 13 as seen in FIG. 6. The means for attaching adjacent pole segments 42 together can be connection members 44 having sleeve-like elements 48 at one end to receive the other end of pole segment 42 into openings 47 which junction means are well known in the art of retaining segmented poles together.

Figure 7:
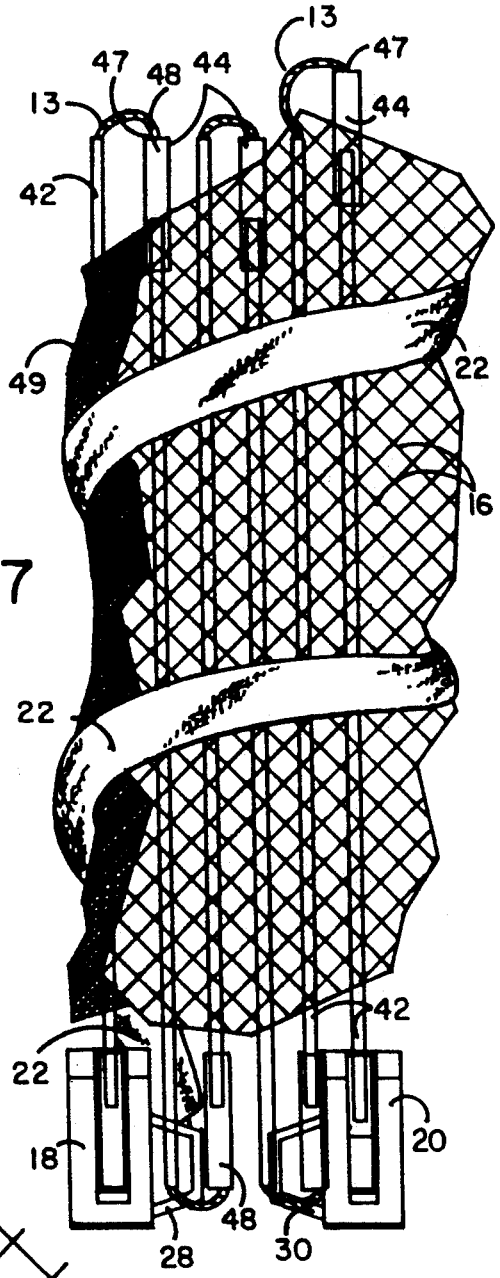
FIG. 7 illustrates a front view of one embodiment of the structure of this invention in its storage mode showing the poles separated from one another into pole segments, the segments being moved parallel to one another, and the attachment members moved closer to one another with the net member and strap wrapped around the poles.

FIG. 7 illustrates the storage mode of this invention wherein pole segments 42 have been detached from one another, and the ends of either the first or the second poles have been detached from its attachment member. The plurality of segment connection members 44 are seen at the ends of adjoining pole segments 42 with cord 13 passing therebetween which cord helps hold the whole structure together during storage. It is not necessary to remove the poles from sleeves 46 and 49 to disengage them into pole segments, but it is necessary to slide the net down toward one end to expose the pole segment connection members 44. To store the sports goal after disengagement of the poles, one puts the segments parallel to one another and wraps net 16 around the segments. Strap member 22 while still connected to a catch member of one attachment member can then be used to wrap and tie the entire dismantled structure together so that it is securely and compactly held for storage. To reassemble the sports goal from its storage mode, one unwraps strap 22 and reattaches all pole segments 42 in their respective sleeves by reengaging the end of each pole segment into the pole segment connection member 44 of the next adjacent pole segment. After each pole is reassembled and attached to the attachment members and the net is slid back along the poles, strap member 22 can be attached between first and second catch members 28 and 31, pulling the attachment members together thereby causing the poles to become curved, as seen in FIG. 1. The device is thereby quickly and easily reassembled. In an alternate embodiment the net member can be omitted entirely from the sports goal.

Although the present invention has been described with reference to particular embodiments, it will be apparent to those skilled in the art that variations and modifications can be substituted therefor without departing from the principles and spirit of the invention.

I claim:

1. A sports goal comprising:

a first pole having a first and second end;

a second pole having a first and second end;

a first attachment member joining said first end of said first pole and said first end of said second pole at approximately 90 degrees to one another;

a second attachment member joining said second end of said first pole and said second end of said second pole at approximately 90 degrees to one another; and means to pull said first and second attachment members inward, causing said first and second poles to become arcuately bowed, said second pole resting horizontally on the ground and said first pole extending upright forming the mouth of said sports goal.

2. The sports goal of claim 1 wherein said means to pull said first and second attachment members inward comprise:

a strap member being shorter in length than the length of either of said first or second poles; and means to attach said strap member to said first attachment member and said second attachment member.

3. The sports goal of claim 2 further including a net member having a first side and a second side extending respectively from said first pole to said second pole.

4. The sports goal of claim 1 further including means for said first pole to be moved to a non-upright position when pressure is placed thereagainst and returnable to its upright position when pressure is removed therefrom.

5. The sports goal of claim 4 wherein said means to move said first pole includes said first pole being composed of resilient and bendable material.

6. The sports goal of claim 1 wherein said first and second poles are comprised of a plurality of engageable and disengageable pole segments.

7. The sports goal of claim 4 wherein said first and second poles are comprised of a plurality of engageable and disengageable pole segments.

8. The sports goal of claim 4 wherein said means for movement of said first pole comprise first and second hinge members attached respectively to the first and second ends of said first pole, said first and second hinge members located respectively within said first and second attachment members.

9. The sports goal of claim 8 wherein said first and second hinge members further include first and second spring members respectively associated therewith.

10. The sports goal of claim 6 wherein said pole segments are hollow and further including a stretchable cord passing through said hollow core interconnecting said pole segments.

11. The sports goal of claim 10 wherein the parts of said sports goal when in its storage mode are retained together when said segmented poles are disengaged from one another.

12. The sports goal of claim 3 further including first and second sleeve members attached respectively along the first and second sides of said net member, said first and second sleeve members receiving respectively said first and second poles therethrough.

* * * * *